United States Patent [19]

Kähkipuro et al.

[11] Patent Number: 4,880,082

[45] Date of Patent: Nov. 14, 1989

[54] METHOD FOR DETERMINING THE POSITION OF AN ELEVATOR CAR AND A PULSE COUNT BASED FLOOR SELECTOR

[75] Inventors: Matti Kähkipuro; Heimo Mäkinen; Jouko Perttula, all of Hyvinkää, Finland

[73] Assignee: Kone Elevator GbmH, Switzerland

[21] Appl. No.: 200,124

[22] Filed: May 26, 1988

[30] Foreign Application Priority Data

May 27, 1987 [FI] Finland ..... 872369

[51] Int. Cl.[4] ..... B66B 3/02

[52] U.S. Cl. ..... 187/134; 73/490

[58] Field of Search ..... 187/116, 134; 73/490; 318/600–603, 651

[56] References Cited

U.S. PATENT DOCUMENTS 3,773,146 11/1973 Dixon, Jr. et al. ..... 187/134
4,009,766 3/1977 Satoh ..... 187/114
4,128,142 12/1978 Satoh et al. ..... 187/116
4,149,147 4/1979 Griffiths et al. ..... 73/490
4,751,984 6/1988 Williams et al. ..... 187/16
4,789,050 12/1988 Evin ..... 187/134

*Primary Examiner*—William M. Shoop, Jr.
*Assistant Examiner*—W. E. Duncanson, Jr.
*Attorney, Agent, or Firm*—Lowe, Price, LeBlanc, Becker & Shur

[57] ABSTRACT

The invention relates to a method and means for determining the position of an elevator car on the principle of floor selection by means of a pulse train, whereby the position of the elevator car is determined on the basis of a pulse count indicating the elevator's speed. The achieve a more reliable pulse count based floor selection system which is suited for use with any type of elevator, the pulses required for calculating the elevator position for floor selection are obtained from an acceleration sensor placed on the elevator car, the output signal of which is integrated so as to obtain a voltage representing the speed of the elevator car, said voltage being converted into a pulse train whose frequency is dependent on the speed of movement of the elevator car.

8 Claims, 1 Drawing Sheet

METHOD FOR DETERMINING THE POSITION OF AN ELEVATOR CAR AND A PULSE COUNT BASED FLOOR SELECTOR

FIELD OF THE INVENTION

The present invention relates to a method for determining the position of an elevator car on the principle of floor selection by means of a pulse train, whereby the elevator position is determined on the basis of a pulse count indicating the elevator's speed, and a pulse count based floor selector for an elevator.

BACKGROUND OF THE INVENTION

One of the central problems in elevator technology is that of determining the actual position of the elevator car in the shaft at any given moment. Various methods have been attempted to solve the problem. They have generally been based on the use of special locating devices mounted in the elevator shaft, such as mechanical floor selectors, punched-tape identifiers, various radar devices, angle detectors, etc. With the development of digital technology and the increasing use of computers as the heart of elevator control systems, electronic sensors producing a more or less continuous pulse train have become common in floor selector systems. Using such sensors it is possible to monitor the movements of an elevator car by observing the pulse count or the pulse frequency, which is proportional to the distance travelled or to the speed of the elevator.

Finnish Patent No. 65409 proposes a floor selector which does not require a separate sensor to produce the pulses for the calculation of the elevator position for floor selection. Instead, the required pulses are produced from the tachometer generator by means of an A/D converter. However, such a system cannot cope with the problem of rope slip, e.g. in connection with emergency braking as there is no provision for the calculations required. Rope slip occurs immediately after the brake has been closed and the elevator car may move through a distance of several metres in this state.

Another drawback is that the solution is not applicable to all types of elevator. It cannot be applied without a tachometer generator, e.g. in hydraulic elevators, because the movements of the elevator car are not a simple function of the rotational speed of any of the shafts of the mover.

SUMMARY OF THE INVENTION

An object of the present invention is to achieve a solution which provides an improvement with respect to the above-mentioned Finnish patent and eliminates the restrictions referred to. To achieve this object, the method of the invention is mainly characterized in that the pulses required for calculating the elevator position for floor selection are obtained from an acceleration sensor placed on the elevator car, the output signal of which is integrated so as to obtain a voltage representing the speed of the elevator car, said voltage being converted into a pulse train whose frequency is dependent on the speed of the elevator car.

A preferred embodiment of the method of the invention is characterized in that the signal representing the elevator's speed is reset when the elevator stops. This provides the advantage that each time when the elevator starts moving after a halt, the system is freed of any counting errors accumulated during the previous drive, such errors being more or less unavoidable.

BRIEF DESCRIPTION OF THE DRAWINGS

Embodiments of the invention will now be described in greater detail and will be better understood when read in conjunction with the following drawings in which.

DESCRIPTION OF THE PREFERRED EMBODIMENT

Figure 1:
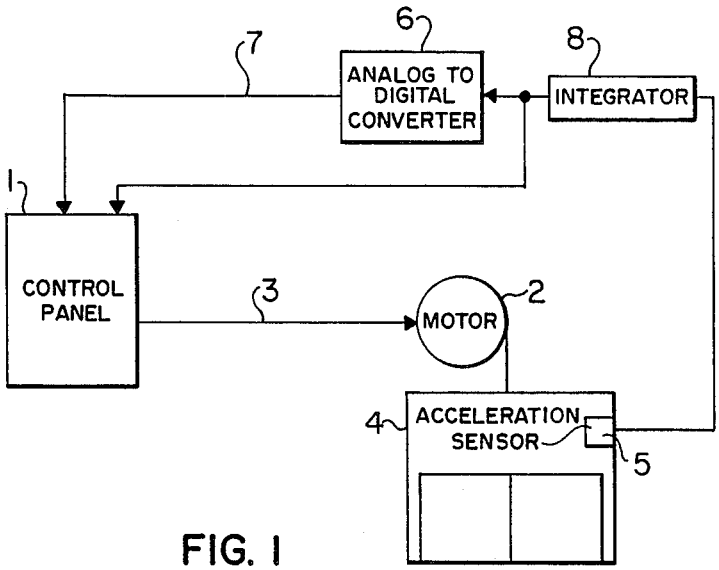
FIG. 1 is a block diagram showing the general arrangement of the present invention.

FIG. 1 shows a pulse count-based floor selector as provided in accordance with one embodiment of the present invention. When the elevator is running, the control panel 1 controls the elevator motor 2 via line 3. An accelerator sensor 5 placed on the elevator car 4 provides a voltage which is proportional to the acceleration of the car. This voltage is integrated with respect to time by an integrator 8, which thus produces a speed signal, which is used to control the A/D converter 6 and the control panel 1 directly (for speed control). The A/D converter provides the continuous pulse train required for floor selection, these pulses being supplied to the control panel via line 7. The A/D converter produces this pulse train by integrating the speed signal with respect to time, so that the frequency of these pulses is directly proportional to the speed of the elevator car. Therefore, the number of pulses produced during a given time interval indicates the distance covered by the elevator car during the same time, as calculated from the equation $s=vt$. Thus, from the pulse count, a computer connected to the control panel 1 can easily determine the position of the elevator car at any given moment.

When the car approaches the destination floor, the door zone identifiers and other equipment used for controlling the elevator speed and stopping procedure operate in the ordinary manner as known in the art. The information provided by the acceleration sensor 5 changes and, as the elevator decelerates, is passed as a speed signal to the control panel 1 and to the A/D converter 6. The frequency of the pulse train supplied by the A/D converter 6 falls correspondingly. When the elevator starts moving again after the halt, the same occurs in the reverse sense.

Figure 2:
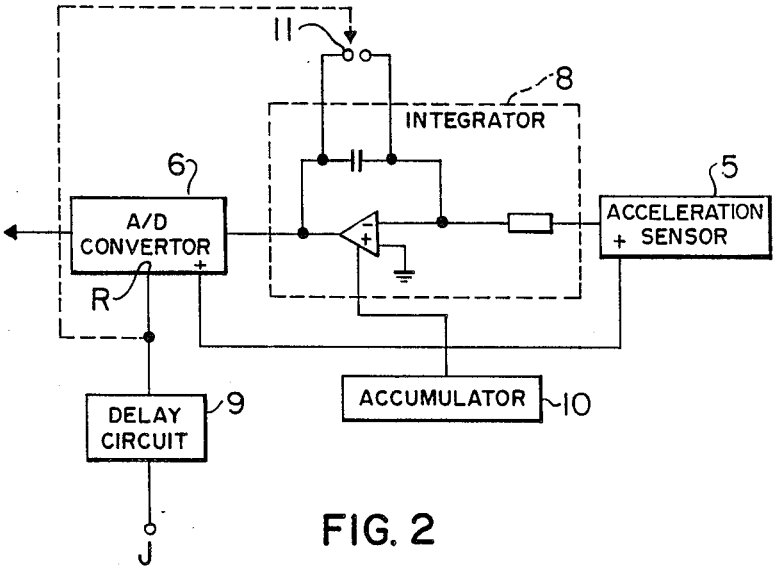
FIG. 2 is a circuit diagram for the present invention.

FIG. 2 is a schematic showing the circuitry of the present floor selector in greater detail. The acceleration sensor 5 may be almost any known kind of acceleration sensor, e.g. a piezo-electric or an electrokinetic one, provided that its accuracy is sufficient for the purpose. The signal voltage obtained from the sensor 5 is integrated by the integrator 8 to produce a speed signal. The integrator is represented by the block surrounded by a broken line in the figure, showing the layout of the integrator circuit. Designing or selecting a suitable acceleration sensor and integrator circuit is a simple task for a person skilled in the art.

The speed signal produced by the integrator is fed into the A/D converter 6, where the signal is first integrated in order to convert the changes of the speed signal relative to time into a quantity which is easier to handle, whereupon the signal is converted into a pulse train.

Depending on the properties of the acceleration sensor and the other components, some errors are always accumulated in the process of counting the pulses, the error being in this case below 1%. To reduce the errors, the speed information is reset when the elevator has stopped by connecting the brake signal J via a delay circuit 9 to the reset input R of the A/D converter 6 and to the reset switch 11 of the integrator. In this manner, a delayed reset operation can be performed on the basis of the brake signal, so that there is enough time for the calculations during the rope slip. The brake signal is obtained either from a switch installed on the brake or from the shut-off valve of a hydraulic elevator. As stated before, rope slip occurs immediately after the closing of the brake. The delay circuit 9 may be implemented using a Schmitt trigger or a counter circuit, so that achieving a desired delay presents no problem to a person skilled in the art.

Correction of the floor selection pulse count at the destination floor, making use of the door zone identifiers and the shaft diagram stored in the memory of the computer, is previously known in the art. The use of floor zone identifiers is stipulated by official safety prescriptions. If necessary, it is naturally possible to correct the pulse count obtained by the method of the invention with respect to door equipment indicating the absolute position of the elevator car. To preserve the pulse count information, e.g. in case of a power failure, the supply of power to the pulse-counting floor selector is preferably backed up by an accumulator or batteries. At least components 5, 6 and 8 should be placed in the elevator car and provided with a back-up accumulator 10, as shown in FIG. 2. Another back-up accumulator should be provided for the microcomputer used for calculating the elevator position.

It is obvious to a person skilled in the art that the invention is not restricted to the above examples of its embodiments, but that it may instead be varied in the scope of the following claims.

We claim:

1. A method for determining the position of an elevator car by means of a pulse train, whereby the position of an elevator car is determined on the basis of a pulse count proportional to the elevator's speed, wherein the pulses required for calculating the elevator position for floor selection are obtained from an acceleration sensor placed on the elevator car, the output signal of which is integrated so as to obtain a voltage representing the speed of the elevator car, said voltage being converted into a pulse train whose frequency is dependent on the speed of the elevator car.

2. Method according to claim 1, wherein the signal carrying the speed information is reset when the elevator stops.

3. Method according to claim 2, wherein the speed signal is reset on the basis of a brake signal employing a certain delay.

4. A pulse count based floor selector for an elevator employing a position determination system based on the counting of pulses indicating the elevator's speed, wherein the floor selector comprises an acceleration sensor, an integrator having a reset switch and being responsive to an output of the acceleration sensor for producing a speed signal, and an A/D converter having a reset input and being responsive to the output of the integrator, which produces the pulse train for position calculation.

5. Pulse count based floor selector according to claim 4, wherein the elevator's brake signal is connected via a delay circuit to the reset input of the A/D converter and to the reset switch of the integrator.

6. Pulse count based floor selector according to claim 5, wherein the supply of power to the floor selector is backed up by an accumulator and/or batteries to preserve the pulse count information.

7. A method for determining the position of an elevator car comprising the steps of:

sensing the acceleration of said elevator car and generating a first electrical signal indicative thereof;

continuously integrating said first signal to calculate the speed of said elevator car, and producing a second electrical signal indicative thereof;

converting said second electrical signal into a pulse train, the frequency of pulses of which is proportional to the speed of said elevator car; and calculating the distance said elevator car has travelled as a function of the number of said pulses in said pulse train.

8. Apparatus for determining the position of an elevator car, comprising:

sensor means for sensing the acceleration of said elevator car and producing a first electrical signal representative of said acceleration;

means for detecting said first electrical signal and responsive thereto producing a second electrical signal proportional to the speed of said elevator car;

conversion means responsive to said second electrical signal for producing a train of electrical pulses in response to the speed of said elevator car; and calculating means for calculating the distance said elevator car has travelled as a function of the number of said pulses produced.

* * * * *